US009597546B2

(12) United States Patent
Maholmes

(10) Patent No.: US 9,597,546 B2
(45) Date of Patent: Mar. 21, 2017

(54) ABDOMINAL TWIST EXERCISE DEVICE

(71) Applicant: Spencer L. Maholmes, Patterson, NJ (US)

(72) Inventor: Spencer L. Maholmes, Patterson, NJ (US)

( * ) Notice: Subject to any disclaimer, the term of this patent is extended or adjusted under 35 U.S.C. 154(b) by 0 days.

(21) Appl. No.: 14/800,495

(22) Filed: Jul. 15, 2015

(65) Prior Publication Data

US 2016/0016038 A1 Jan. 21, 2016

Related U.S. Application Data

(60) Provisional application No. 61/999,190, filed on Jul. 19, 2014.

(51) Int. Cl.
*A63B 21/045* (2006.01)
*A63B 23/02* (2006.01)
(Continued)

(52) U.S. Cl.
CPC .... *A63B 23/0211* (2013.01); *A63B 21/00069* (2013.01); *A63B 21/00185* (2013.01); *A63B 21/06* (2013.01); *A63B 21/0616* (2015.10); *A63B 21/0617* (2015.10); *A63B 22/14* (2013.01); *A63B 23/0233* (2013.01); *A63B 23/12* (2013.01); *A63B 71/0619* (2013.01); *A63B 2023/003* (2013.01); *A63B 2024/0065* (2013.01); *A63B 2071/065* (2013.01); *A63B 2071/0658* (2013.01); *A63B 2208/0204* (2013.01); *A63B 2208/0214* (2013.01); *A63B 2208/0233* (2013.01); *A63B 2225/09* (2013.01); *A63B 2225/093* (2013.01)

(58) Field of Classification Search
CPC . A63B 23/0211; A63B 23/12; A63B 23/0233; A63B 21/00185; A63B 21/0617; A63B 21/0616; A63B 21/06; A63B 21/00069; A63B 22/24; A63B 71/0619; A63B 2024/0065; A63B 2225/093; A63B 2071/0658; A63B 2071/065; A63B 2208/0204; A63B 2208/0214; A63B 2023/003; A63B 2225/09
See application file for complete search history.

(56) References Cited

U.S. PATENT DOCUMENTS 3,784,193 A * 1/1974 Simjian ..... A63B 22/14 482/118
4,296,924 A 10/1981 Anzaldua et al.
(Continued)

*Primary Examiner* — Loan H Thanh
*Assistant Examiner* — Megan Anderson
(74) *Attorney, Agent, or Firm* — IDP Patent Services; Olav M. Underdal

(57) ABSTRACT

An abdominal twist exercise device includes a device frame, front and rear rotational axles, a main handle bar, a rotation converter, an adjustable gear, a disengaging lever, a weight, a weight bar, a support rail, a safety handle bar, rotation counters, and a user platform, such that when the main handle bar rotates to one side, the user platform rotates to an opposing side. A rotation converter can include a front chain sprocket, an intermediate rotational axle, an intermediate chain sprocket, a roller chain, an intermediate gear, a rear gear; or a front belt sprocket, a rear belt sprocket, and a twisted belt, connecting the sprockets. Optionally, the front and rear axles can be telescoping.

25 Claims, 9 Drawing Sheets

(51) Int. Cl.

| | |
|---|---|
| ***A63B 21/00*** | (2006.01) |
| ***A63B 71/06*** | (2006.01) |
| ***A63B 21/06*** | (2006.01) |
| ***A63B 22/14*** | (2006.01) |
| ***A63B 23/12*** | (2006.01) |
| *A63B 23/00* | (2006.01) |
| *A63B 24/00* | (2006.01) |

(56) References Cited

U.S. PATENT DOCUMENTS

| | | | | |
|---|---|---|---|---|
| 6,213,924 | B1 | 4/2001 | Kaiyoorawongs | |
| 6,468,191 | B1 | 10/2002 | Cameron | |
| 6,475,123 | B1 | 11/2002 | Evans | |
| 6,902,514 | B2 * | 6/2005 | Chuang | A63B 22/001 482/147 |
| 6,918,861 | B2 * | 7/2005 | Liao | A63B 22/14 482/146 |
| 7,438,675 | B2 | 10/2008 | Lin | |
| 7,481,752 | B2 | 1/2009 | Garner | |
| 7,789,817 | B2 | 9/2010 | Wang | |
| 7,909,736 | B2 | 3/2011 | Hoeven et al. | |
| 8,118,720 | B2 | 2/2012 | Sebastian | |
| 8,210,998 | B2 | 7/2012 | Chen et al. | |
| 8,790,226 | B2 | 7/2014 | Goel et al. | |
| 8,870,726 | B2 | 10/2014 | Watterson et al. | |
| 8,944,981 | B2 | 2/2015 | Ho et al. | |
| 9,028,376 | B2 | 5/2015 | Ho et al. | |
| 2003/0092546 | A1 * | 5/2003 | Yu | A61H 1/0255 482/142 |
| 2004/0097337 | A1 * | 5/2004 | Chuang | A63B 22/001 482/52 |
| 2005/0043143 | A1 * | 2/2005 | Chuang | A63B 22/14 482/51 |

* cited by examiner

Abdominal Twist Exercise Device

Rotation Converter

Rotational Mounting

Abdominal Twist Exercise Device

Abdominal Twist Exercise Device

Kneeling Configuration

Sitting Configuration

Standing Configuration

ABDOMINAL TWIST EXERCISE DEVICE

CROSS-REFERENCE TO RELATED APPLICATIONS

This application claims the benefit of U.S. Provisional Application No. 61/999,190, filed Jul. 19, 2014.

FIELD OF THE INVENTION

The present invention relates generally to the field of exercise devices, and more particularly to exercise devices, systems and methods for exercising abdominal muscles in conjunction with counter-rotating motions.

BACKGROUND OF THE INVENTION

Many fitness enthusiasts include exercise routines to firm up abdominal muscles with the goal of developing a well-toned abdominal musculature.

Some abdominal exercise machines are constructed to exercise muscles by toning and strengthening the waist by lying down in a sit-up position. Other machines exercise the waist while a user is in a sitting or kneeling position, moving the knees back and forth, such that resulting crunches tone abdominal muscles. By use of similar mechanism, most abdominal exercise machines have the ability to firm up muscles in the body middle section.

In general, existing devices for exercise of abdominal muscles have complex and expensive designs, which can be uncomfortable in use due to reliance on strenuous crunching movements. In addition, most existing designs may cause back pain and may not be useable by persons with existing lower back problems.

As such, considering the foregoing, it may be appreciated that there continues to be a need for novel and improved devices and methods for training abdominal muscles.

SUMMARY OF THE INVENTION

The foregoing needs are met, to a great extent, by the present invention, wherein in aspects of this invention, enhancements are provided to the existing model of training abdominal muscles, by use of counter-rotating parts.

In an aspect, an abdominal twist exercise device, can include a) front and rear rotational axles;

b) a main handle bar; which is connected to the front axle;

c) a rotation converter, which connects the front rotational axle with the rear rotational axle, such that a rotation to one side of the front rotational axle is converted to a counter-rotation to the opposing side of the rear rotational axle; and d) a user platform, which is connected to the rear rotational axle;

such that when the main handle bar rotates to one side, the user platform rotates to an opposing side.

In a related aspect, the rotation converter can include:

a) a front chain sprocket, which is perpendicularly mounted on the front rotational axle;

b) an intermediate rotational axle, which is connected to the device frame;

c) an intermediate chain sprocket, which is perpendicularly connected to the intermediate rotational axle;

d) a roller chain, which is connected around the front and rear chain sprockets, such that a rotation to one side of the front rotational axle causes a same side rotation of the intermediate rotational axle;

e) an intermediate gear which is perpendicularly connected to the intermediate rotational axle; and f) a rear gear, which is perpendicularly connected to the rear rotational axle;

such that the intermediate gear and the rear gear are in meshing connection, thereby connecting the intermediate and rear rotational axles, such that that a right or a left rotation of the intermediate rotational axle causes respectively a left or a right rotation of the rear rotational axle.

In another related aspect, the rotation converter can include:

a) a front belt sprocket, which is connected to the front rotational axle;

b) a rear belt sprocket, which is connected to the rear rotational axle; and c) a belt, which is connected in around the front and rear belt sprockets, such that the belt is twisted 90 degrees between the front and rear belt sprockets;

such that a right or left rotation of the front rotational axle causes respectively a left or right rotation of the rear rotational axle.

In yet a related aspect, the rotation converter can be configured with a total gearing ratio in a range of 1:3 to 3:1.

In yet a related aspect, the rotation converter further comprises at least one adjustable gear, which is configured to adjust the total gearing ratio of the rotation converter.

In a related aspect, the abdominal twist exercise device, can include one or more weights, which can be attached to one or both of the rotational axles.

In a related aspect, the front rotational axle can be telescoping, such that the height of the hand bar is adjustable.

In a related aspect, the rear rotational axle can be telescoping, such that the height of the user platform is adjustable.

In a related aspect, the abdominal twist exercise device can further include a safety handle bar, which can be attached to the device frame via an elongated support rail.

In a related aspect, the abdominal twist exercise device can further include a disengaging lever, which can disable the function of the rotation converter, such that the front and rear rotational axles can rotate independently.

In a related aspect, the abdominal twist exercise device can further include counters for counting rotations of the front and rear axles.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
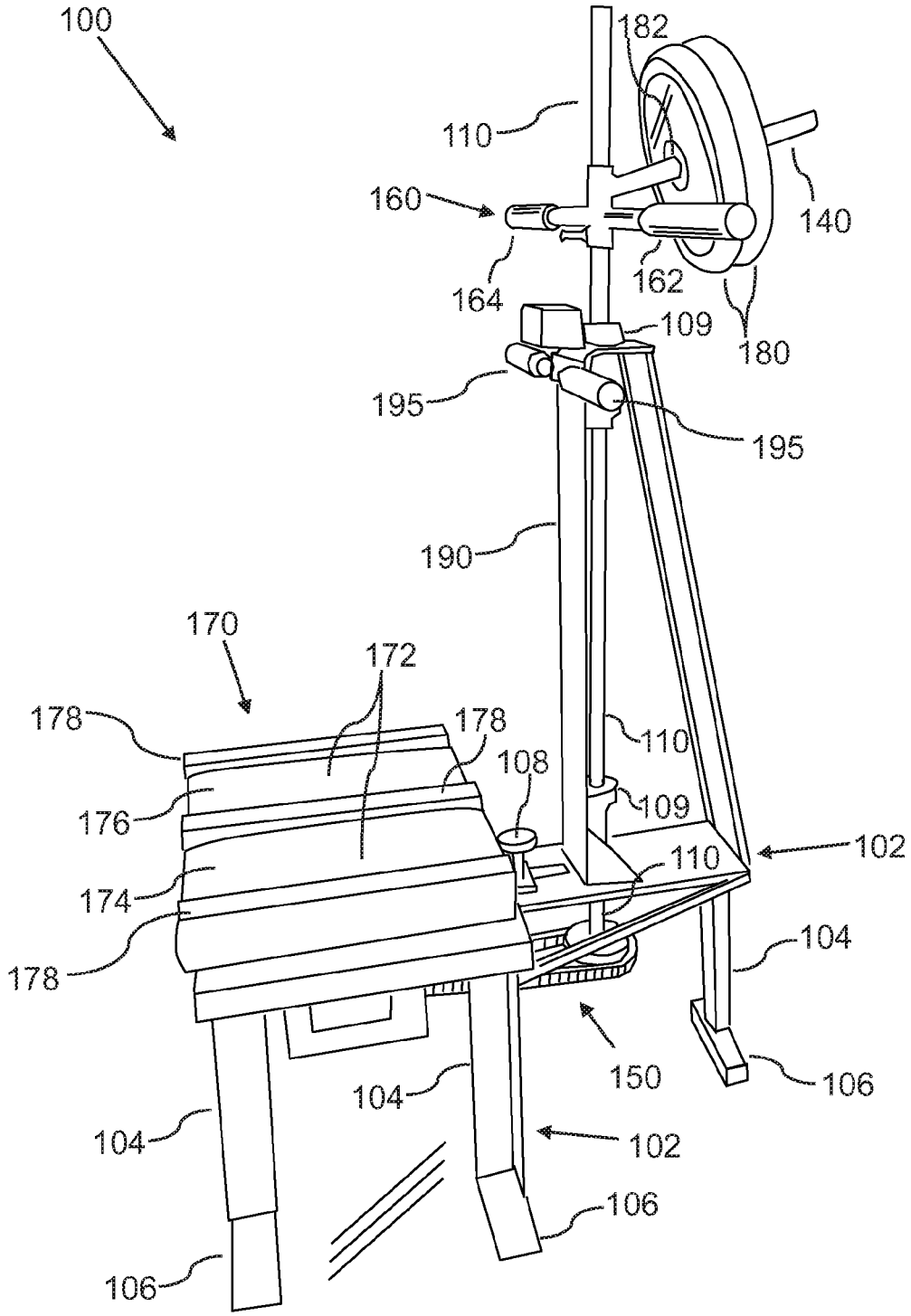
FIG. 1 is a perspective view of an abdominal twist exercise device, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of an abdominal twist exercise device 100 with reference to FIG. 1, in such manner that like reference numerals refer to like components throughout; a convention that we shall employ for the remainder of this specification.

Figure 2:
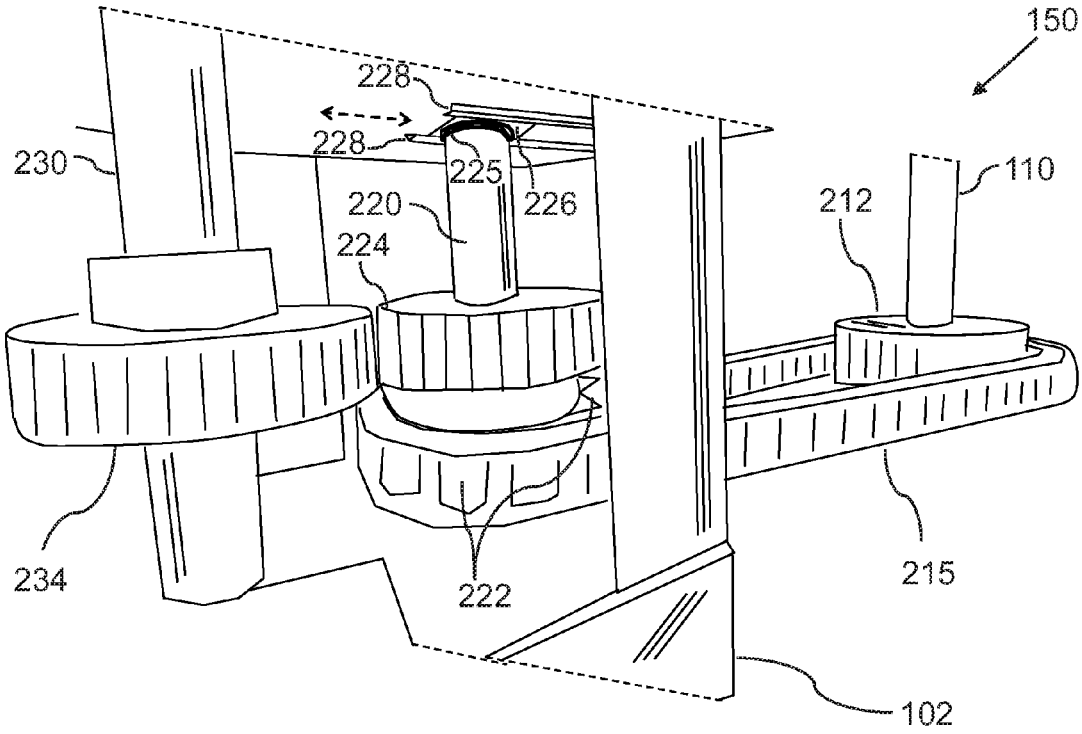
FIG. 2 is a perspective view of a rotation converter of an abdominal twist exercise device, according to an embodiment of the invention.

In an embodiment, as shown in FIG. 1, an abdominal twist exercise device 100 can include:

a) A device frame 102;

b) A front rotational axle 110, which is rotationally connected in a lower end to the device frame 102, for example via at least one bearing 109, which can be a ball bearing 109, such that the front rotational axle 110 extends vertically upwards from the device frame;

c) A main handle bar 160; which is connected to an upper end of the front rotational axle 110;

d) A rear rotational axle 230, as shown in FIG. 2, which is rotationally connected to the device frame 102, to a rear of the front rotational axle, for example via at least one ball bearing, such that the rear rotational axle 230 extends vertically upwards from the device frame;

e) A rotation converter 150, only partially shown in FIG. 1, which connects the front rotational axle 110 with the rear rotational axle 230, such that a right or a left rotation of the front rotational axle, is converted to respectively a left or right rotation of the rear rotational axle; and f) A user platform 170, which is connected to the rear rotational axle 230, such that the user platform 170 is configured to be rotatable in a horizontal plane relative to the device frame 102, also referred to as horizontally rotatable;

whereby a user can sit, kneel, or stand on the user platform 170, while holding left and right sides of the main handle bar 160, with respectively left and right hands, such that the user can engage in a plurality of rotational movements, such that when the user rotates the main handle bar 160 to a left side, thereby rotating his upper body to the left side, the user platform 170 rotates to a right side, thereby rotating his lower body to the right side; and when the user rotates the main handle bar 160 to a right side, thereby rotating his upper body to the right side, the user platform 170 rotates to the left side, thereby rotating his lower body to the left side.

FIG. 1 shows an embodiment wherein the abdominal twist exercise device 100 is designed for a user to kneel on the user platform 170, while facing in direction of and holding the main handle bar 160.

In a related embodiment, FIG. 2 shows an example configuration of a rotation converter 150, including:

a) A front chain sprocket 212, which is perpendicularly connected to the front rotational axle 110, such that the front chain sprocket 212 is configured to be rotatable in a front horizontal plane;

b) An intermediate rotational axle 220, which is rotationally connected to the device frame 102, for example via at least one ball bearing, such that the intermediate rotational axle 220 is parallel to the front rotational axle 110;

c) An intermediate chain sprocket 222, which is perpendicularly connected to the intermediate rotational axle, such that the intermediate chain sprocket 222 is configured to be rotatable in the front horizontal plane;

d) A roller chain 215, which is connected in a front end around the front chain sprocket 212 and in a rear end around the intermediate chain sprocket 222, such that a right or left rotation of the front rotational axle 110 causes respectively a right or left rotation of the intermediate rotational axle;

e) An intermediate gear 224 which is perpendicularly connected to the intermediate rotational axle 220, such that the intermediate gear 224 is configured to be rotatable in a rear horizontal plane; and f) A rear gear 234 which is perpendicularly connected to the rear rotational axle 230, such that the rear gear 234 is configured to be rotatable in the rear horizontal plane;

such that the intermediate gear 224 and the rear gear 234 are meshing and configured as a gear train, which connects the intermediate rotational axle 220 with the rear rotational axle 230, such that that a right or a left rotation of the intermediate rotational axle 220 causes respectively a left or a right rotation of the rear rotational axle 230.

In a various related embodiments, the rotation converter 150 can be configured with a total gearing ratio, X:Y, such that X rotations of the front rotational axle 110 causes Y counter-rotations of the rear rotational axle 230. The total gearing ratio, can in general be configured in range from 1:3 to 3:1, but may in some cases be configured with larger ranges, for example up to from 1:10 to 10:1.

In a related example embodiment, the rotation converter 150 can be configured such that:

a) The front chain sprocket 212 has 20 teeth;

b) The intermediate chain sprocket 222 has 10 teeth;

c) The intermediate gear 224 has 45 teeth; and d) The rear gear 234 has 37 teeth;

whereby the rotation converter 150 is configured with a total gearing ratio of approximately 1:2.2, such that a rotation of the front rotational axle 110 of approximately 41 degree to the right or left, causes a corresponding rotation of the rear rotational axle 230 of 90 degrees to respectively the left or right side.

In related embodiments, a total gearing ratio in the range of 1:1.5 to 1:3.0 can be beneficial for some users that wish to have a larger rotation of the lower body, as compared to a smaller rotation of the upper body, including shoulders and arms. Thus, adjustment of the total gearing ratio can be used to adjust the relative degree of rotation of the upper body versus the lower body of a user.

Figure 3:
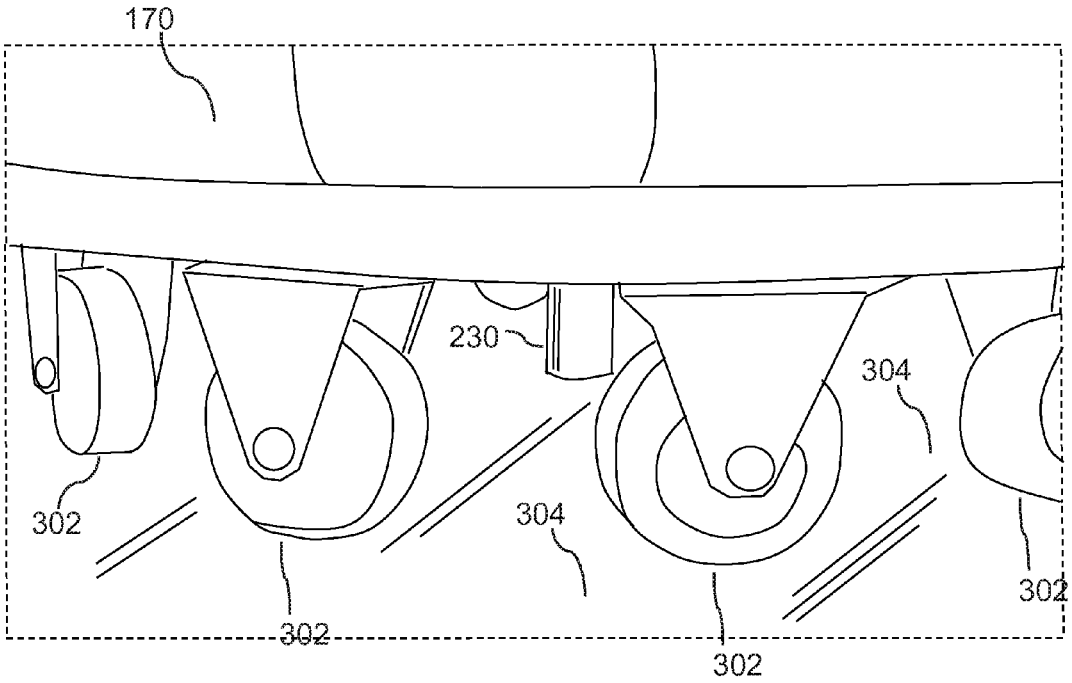
FIG. 3 is a perspective view of a platform rotational mounting of an abdominal twist exercise device, according to an embodiment of the invention.

In a related embodiment, as shown in FIG. 3, a plurality of caster wheels 302 can be mounted in a circle on an underside of the user platform 170, such that the caster wheels 302 roll on a flat surface 304, which is connected to the device frame 102, such that the caster wheels 302 roll in a circle that encircles the rear rotational axle 230, such that the caster wheels stabilize and support the user platform 170.

In an alternative related embodiment, the user platform 170 can be supported by a heavy-duty swivel that is mounted on a lower end to the device frame 102 and in an upper end to the underside of the user platform 170, such that the swivel has a central aperture to allow the rear rotational axle 230 to pass through, for the rear rotational axle 230 to connect with the user platform 170.

In an alternative related embodiment, the user platform can be supported by a connection to the rear rotational axle only, using similar well known design methods as for example used in a design of a heavy duty office chair, with a pneumatic rotational central axis, wherein the rear rotational axle 230 is supported by one or more bearings that connect the rear rotational axle 230 to the device frame, while allowing rotation of the rear rotational axle 230.

Figure 4:
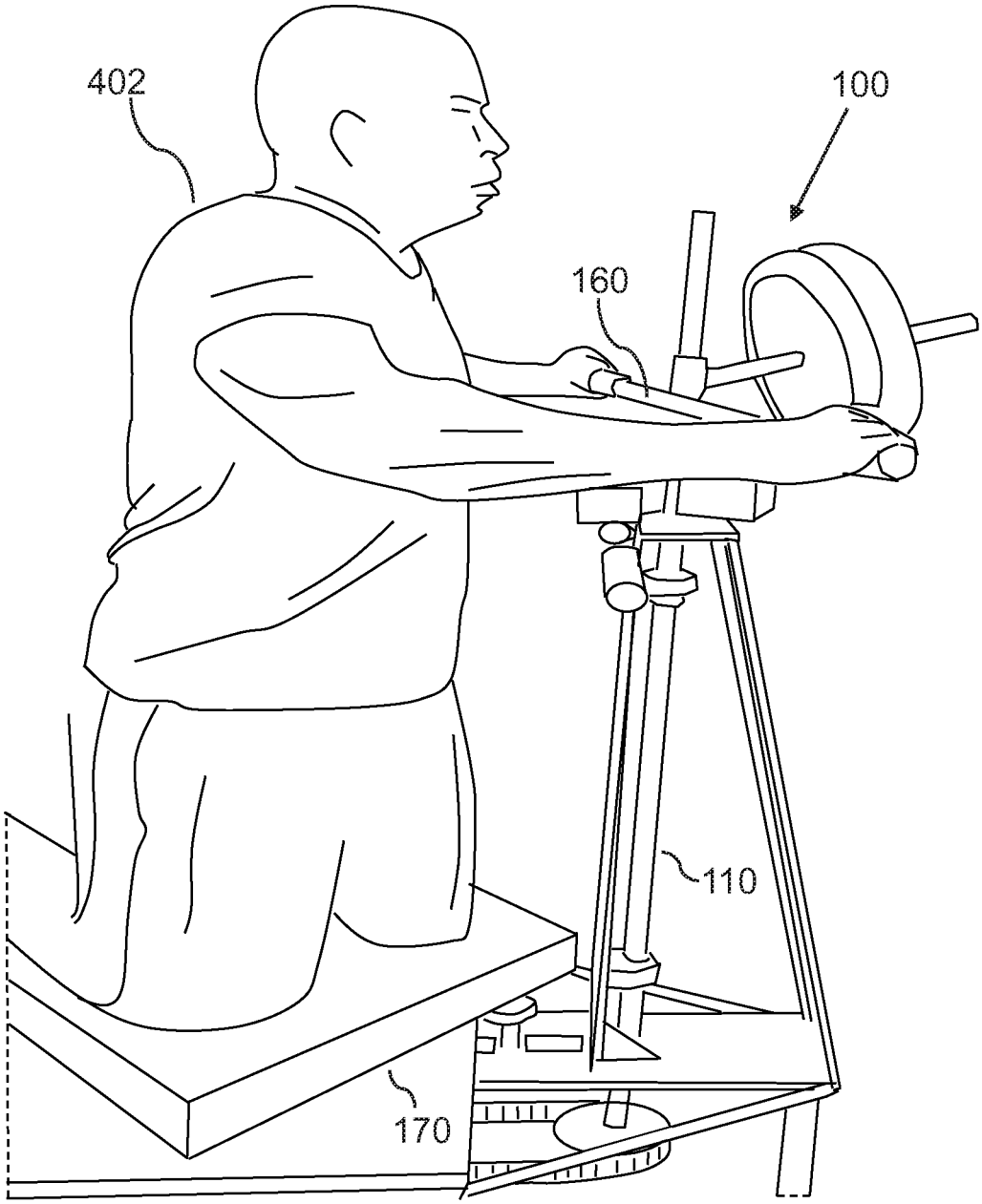
FIG. 4 is a perspective view of an abdominal twist exercise device in use, according to an embodiment of the invention.

FIG. 4 shows a user 402 using an embodiment of the abdominal twist exercise device 100, configured for use in a kneeling position. FIG. 4 shows a snapshot of an ongoing movement wherein the main handle bar 160 is rotating to the left, and the user platform 170 is rotating to the right.

Figure 5:
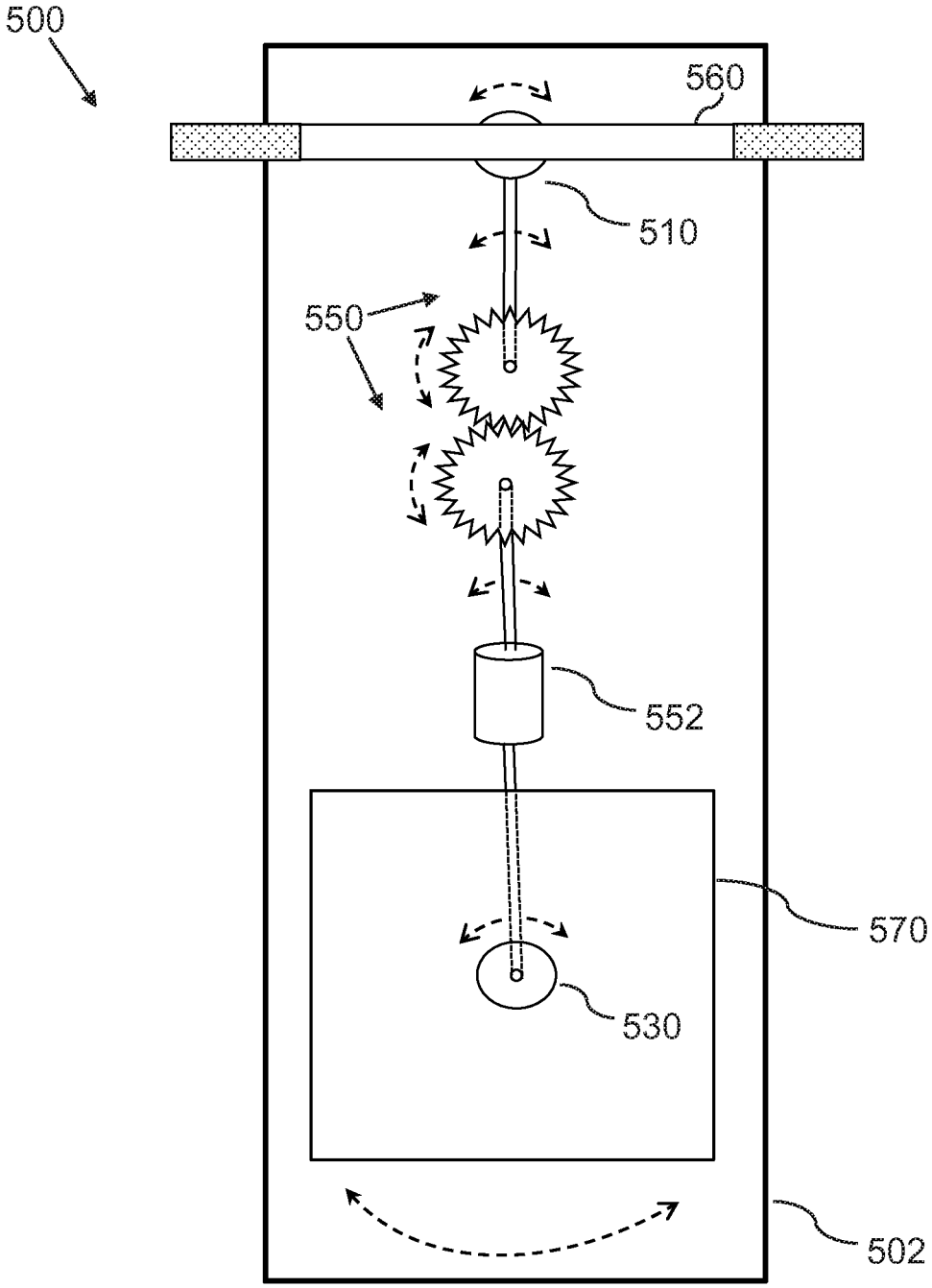
FIG. 5 is a schematic diagram of an abdominal twist exercise device, according to an embodiment of the invention.

In another embodiment, as shown in a schematic diagram in FIG. 5, an abdominal twist exercise device 500 can include:

a) A device frame 502;

b) A front rotational axle 510, which is connected in a lower end to the device frame 502, for example via at least one ball bearing;

c) A main handle bar 560; which is connected to an upper end of the front rotational axle 510;

d) A rear rotational axle 530, which is rotationally connected to the device frame 502, for example via at least one ball bearing;

e) A rotation converter 550, which connects the front rotational axle 510 with the rear rotational axle 530, such that a right or a left rotation of the front rotational axle, is converted to respectively a left or right rotation of the rear rotational axle; and f) A user platform 570, which is connected to the rear rotational axle 530, such that the user platform 570 is configured to be rotatable in a horizontal plane relative to the device frame;

whereby a user can sit, kneel, or stand on the user platform 570, while holding left and right sides of the main handle bar 560, with respectively left and right hands, such that the user can engage in a plurality of rotational movements; such that when the user rotates the main handle bar 560 to a left side, thereby rotating his upper body to the left side, the user platform 570 rotates to a right side, thereby rotating his lower body to the right side; and when the user rotates the main handle bar 560 to a right side, thereby rotating his upper body to the right side, the user platform 570 rotates to the left side, thereby rotating his lower body to the left side.

The skilled artisan of the mechanical arts, and other persons with ordinary skill in the art of rotational mechanical devices, will readily recognize that there can be a plurality of related embodiments, which can implement the rotation converter 550, with different gear mechanisms, or with twisted belts or cables, and like mechanisms for reversing rotation.

In a related embodiment, the rotation converter 550 can further include at least one adjustable gear, which can be a multi-gear box or a continuously variable transmission, such that the total gearing ratio of the rotation converter can be adjusted during use. Such an adjustable gear can utilize readily available gearing components commonly used for bicycles, and other vehicles, such as an external derailleur gear or an internal hub gear, such as for example, a Rohlhoff Speedhub™, manufactured by Rohlhoff AG.

In further related embodiments, an adjustable gear can be mounted on either front or rear rotational axles 110 230, such that the rotational axle is comprised of an upper and lower part, that is connected via the adjustable gear.

Figure 10:
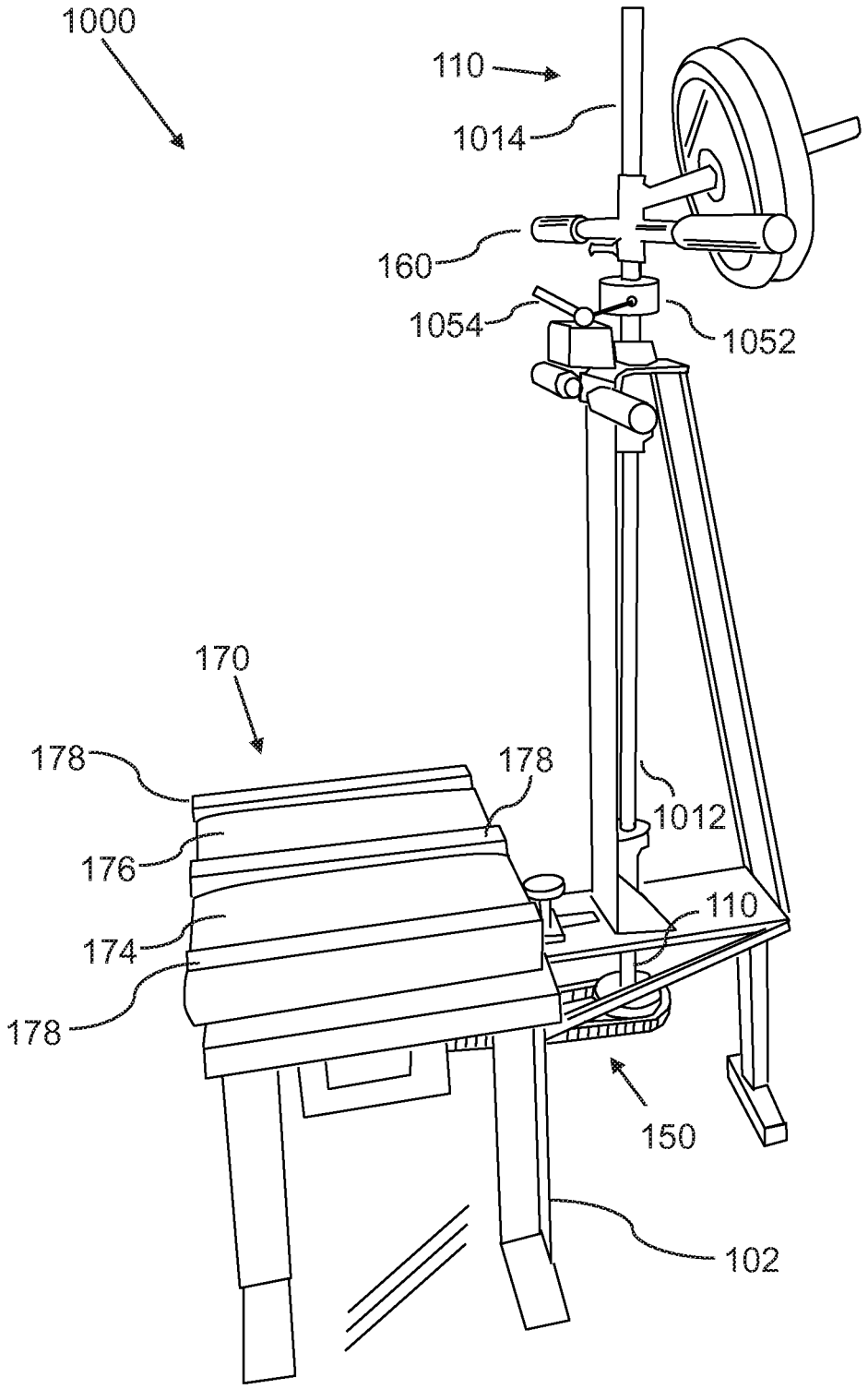
FIG. 10 is a perspective view of an abdominal twist exercise device, according to an embodiment of the invention.

In a related embodiment, as shown in FIG. 10, an abdominal twist exercise device 1000, can include:

a) A front rotational axle 110, which can further include:

i. An upper front rotational axle 1014; and ii. A lower front rotational axle 1012; and b) An adjustable gear 1052;

Wherein the upper and lower front rotational axles 1014 1012 are connected via the adjustable gear 1052.

In a further related embodiment, as shown in FIG. 10, the abdominal twist exercise device 1000 can further include a gear selection lever 1054, which can be connected to the adjustable gear 1052, for example via a cable or other mechanical connection, in order to change a gear selection of the adjustable gear 1052.

Figure 6:
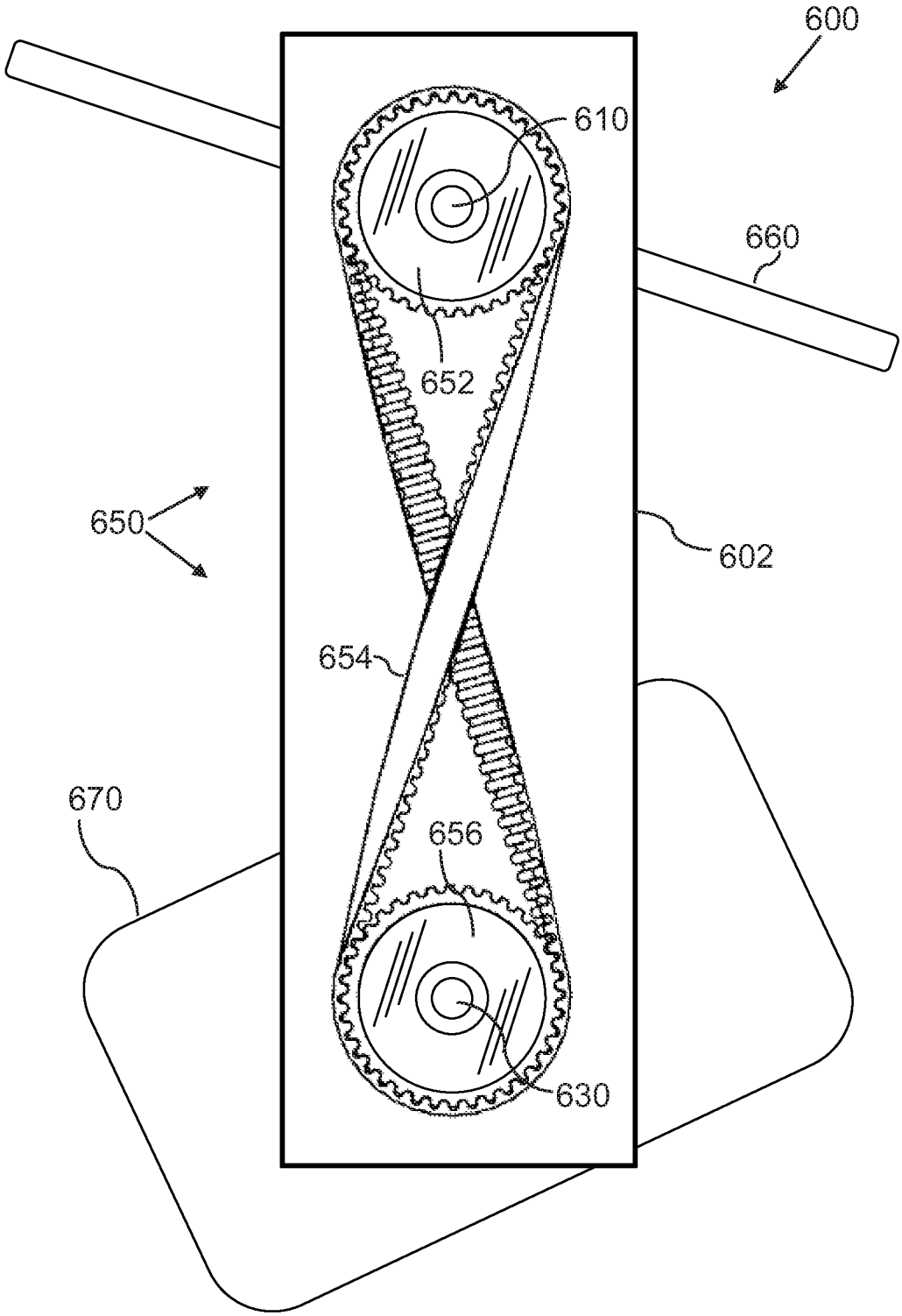
FIG. 6 is a perspective view of an abdominal twist exercise device, showing a rotation converter, according to an embodiment of the invention.

In another embodiment, FIG. 6 illustrates a bottom view, of an alternative embodiment of an abdominal twist exercise device 600, including:

a) A device frame 602;

b) A front rotational axle 610, which is connected in a lower end to the device frame 602, for example via at least one ball bearing;

c) A main handle bar 660; which is connected to an upper end of the front rotational axle 610;

d) A rear rotational axle 630, which is rotationally connected to the device frame 602, for example via at least one ball bearing;

e) A rotation converter 650, which connects the front rotational axle 610 with the rear rotational axle 630, such that a right or a left rotation of the front rotational axle, is converted to respectively a left or right rotation of the rear rotational axle, wherein the rotation converter further comprises:

i. A front belt sprocket 652, perpendicularly connected to a lower end of the front rotational axle 610;

ii. A rear belt sprocket 656, perpendicularly connected to a lower end of the rear rotational axle 630; and iii. A belt 654, which is connected in a front end around the front belt sprocket 652 and in a rear end around the rear belt sprocket 656, such that the belt 654 is twisted 90 degrees between the front and rear belt sprockets 652 656, such that a right or left rotation of the front rotational axle 652 causes respectively a left or right rotation of the rear rotational axle 656;

f) A user platform 670, which is connected to the rear rotational axle 630, such that the user platform 670 is configured to be rotatable in a horizontal plane relative to the device frame;

whereby a user can sit, kneel, or stand on the user platform 670, while holding left and right sides of the main handle bar 660, with respectively left and right hands, such that the user can engage in a plurality of rotational movements; such that when the user rotates the main handle bar 660 to a left side, thereby rotating his upper body to the left side, the user platform 670 rotates to a right side, thereby rotating his lower body to the right side; and when the user rotates the main handle bar 660 to a right side, thereby rotating his upper body to the right side, the user platform 670 rotates to the left side, thereby rotating his lower body to the left side.

In a related embodiment, the front rotational axle 110 510 610 and the rear rotational axle 230 530 630 can be considered optional parts of the rotation converter 150 550 650, such that an abdominal twist exercise device 100 500 600, can include:

a) a main handle bar 160 560 660; which is configured to be horizontally rotatable;

b) a user platform 170 570 670, which is configured to be horizontally rotatable; and c) a rotation converter 150 550 650, which connects the main handle bar 160 560 660 with the rear user platform 170 570 670, wherein the rotation converter 150 550 650 is configured such that a right or a left rotation of the main handle bar 160 560 660 is converted to respectively a left or right rotation of the user platform 170 570 670;

whereby the abdominal twist exercise device is configured such that when the main handle bar 160 560 660 rotates to a left side, the user platform 170 570 670 rotates to a right side; and such that when the main handle bar 160 560 660 rotates to a right side 160 560 660, the user platform 170 570 670 rotates to a left side.

In a further related embodiment, the abdominal twist exercise device 100 500 600 can further include:

a) a device frame 102 502 602, such that the main handle bar 160 560 660 and the user platform 170 570 670 are rotationally connected to the device frame 102 502 602; and b) a plurality of legs 104, which are connected to the device frame 102 502 602 and protrude downwards from the device frame 102 502 602;

such that the abdominal twist exercise device 100 500 600 is configured to be positioned with the legs 104 on a floor surface.

In a related embodiment, as shown in FIG. 1, the main handle bar 160 can have padded hand grips 162 164 in right and left ends of the main handle bar 160.

In a related embodiment, weights 180 can be attached to the front rotational axle 110 in order to exercise a user of the abdominal twist exercise device 100 500 600.

In a further related embodiment, a weight bar 140 can be attached to the front rotational axle, such that the weight bar 140 is protruding from the front rotational axle at an upward angle, such that at least one weight 180 can be attached to the weight bar 140. As shown in FIG. 1, the weight 180 can include a central aperture 182, such that the weight 180 is configured to slide on to the weight bar 140, such that the weight bar 140 extends through the aperture 182. The weight 180 can be secured in place on the weight bar 140 with a clip or pin, or other similar well known mechanism for securing a weight in place on a bar.

Figure 7:
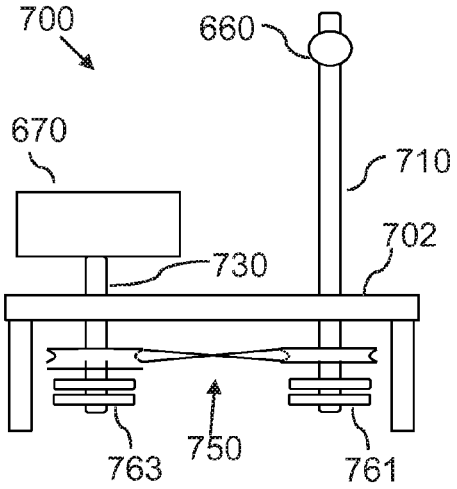
FIG. 7 is a perspective view of an abdominal twist exercise device, configured for use in a kneeling position, according to an embodiment of the invention.

In another further related embodiment, as shown in FIG. 7, one or more weights 761 can be mounted to the front rotational axle 710, for example as shown in a lower end of the front rotational axle 710, such that the weights 761 slide on to the front rotational axle 710, with the front rotational axle 710 protruding through central apertures 182 of the weights. The weights 761 can be secured in place on the front rotational axle 710 with a clip or pin, or other similar well known mechanism for securing a weight in place on a bar or axle.

In yet another further related embodiment, as shown in FIG. 7, one or more weights 763 can be mounted to the rear rotational axle 730, for example as shown in a lower end of the rear rotational axle 730, such that the weights 763 slide on to the rear rotational axle 730, with the rear rotational axle 730 protruding through central apertures 182 of the weights 763. The weights 763 can be secured in place on the rear rotational axle 730 with a clip or pin, or other similar well known mechanism for securing a weight in place on a bar or axle.

In other related embodiments, rotation of the front or rear rotational axle 110 230 can be provided with resistance from one or two flywheels, which are coupled to the front or rear rotational axle 110 230, such that the abdominal twist exercise device 100 can be configured with the one or two flywheels according to well-known design methods for use of flywheels in exercise devices, such as training bikes, etc.

In other related embodiments, rotation of the front or rear rotational axle 110 230 can be provided with resistance from one or two weight stacks that which are coupled to the front or rear rotational axle 110 230, via a system of cables and pulleys, such that weight stacks are pulled up and down with rotation of the front or rear rotational axle, such that the abdominal twist exercise device 100 can be configured with the one or two flywheels according to well-known design methods for use of flywheels in exercise devices, such as training bikes, etc. In a related embodiment, the abdominal twist exercise device 100 can be configured such that a first weight stack is lifted when the front rotational axle 110 is rotated to the right, and a second weight stack is lifted when the front rotational axle 110 is rotated to the left.

In a further related embodiment, a height of the main handle bar 160 can be configured to be adjustable. For example such that the main handle bar 160 can be attached to a tube with holes, such that the tube slides on an outer side of the front rotational axle 110, and is locked in place with a locking lever, which for example can be a pin inserted through a hole in the tube and through a hole in the front rotational axle 110.

In a yet further related embodiment, the front rotational axle 110 can be telescoping, such that a height of the main handle bar 160 is adjusted by adjusting a length of the telescoping rotational axle 110.

In a related embodiment, as shown in FIG. 1, the abdominal twist exercise device 100 can further include a) An elongated support rail 190, which extends vertically from the device frame 102; and b) A safety handle bar 195, which is attached to an upper end of the support rail 190;

such that the user can use the non-rotating and stable safety handle bar for support when stepping onto the abdominal twist exercise device 100 and/or as needed during use of the abdominal twist exercise device 100.

In related embodiments, the device frame 102, front and rear rotational axles 110 230, main handle bar 160, support rail 190, safety handle bar 195, and other parts of the abdominal twist exercise device 100, can be made from high-strength metals and metal alloys, such as steel, stainless steel, and aluminum alloys.

In a related embodiment, the device frame 102 can further include downward protruding legs 104, in each corner of the device frame 102, such that the abdominal twist exercise device 100 can be positioned on a floor surface. The legs 104 can further include feet 106 connected to a lower end of the legs.

In related embodiments, the user platform 170 can further include a cushion padding 172, for use in configurations of the abdominal twist exercise device 100 for sitting or kneeling use.

In a related embodiment, the user platform 170 can further include:

a) right and left elongated leg indentations 174 176, on an upper surface of the user platform 170, which are parallel in direction of a front of the abdominal twist exercise device 100, when the user platform is in a non-rotated position; and b) and optionally dividers 178 to mark the sides and center of the user platform, along the left and right elongated leg indentations 174 176.

In a related embodiment, as shown in FIG. 1, the abdominal twist exercise device 100 can further include a disengaging lever 108, which disengages the rotation converter 150, such that the front and rear rotational axles 110 230 rotate independently. When the disengaging lever 108 is pulled back, the intermediate rotational axle 220 slides forward, such that the intermediate gear 224 is removed from contact with the rear gear 234, whereby the function of the rotation converter is disengaged.

In a further related embodiment, as shown in FIG. 2, a top end of the intermediate rotational axle 220 can be rotationally mounted with a ball bearing 225 to a plate 226, such that the plate 226 can slide in rails 228, and such that the plate 226 is connected to the disengaging lever 108.

In a further related embodiment, operation of the abdominal twist exercise device 100 with the rotation converter 150 disengaged can allow a user to:

a) use the abdominal twist exercise device 100, to rotate the main handle bar 160 only; or b) use the abdominal twist exercise device 100, to rotate the user platform 170 only, while the user holds onto the non-rotating safety handle bar 195.

In a related embodiment, the abdominal twist exercise device 100 can further include a protective cover, which can be mounted to a lower part of the device frame 102, in order to protect parts of the abdominal twist exercise device 100, including the rotation converter 150 550 650.

In various related embodiment, the abdominal twist exercise device 100 500 600 can be used in one-hand operation, such that a first hand holds the rotating main handle bar 160, and optionally a second hand holds onto the non-rotating safety handle bar 195.

In a related embodiment, as shown in FIG. 7, an abdominal twist exercise device 700, configured for use in a kneeling position, can include:

a) A device frame 702;

b) A front rotational axle 710, which is connected in a lower end to the device frame 702, for example via a ball bearing;

c) A main handle bar 660; which is connected to an upper end of the front rotational axle 710;

d) A rear rotational axle 730, which is rotationally connected to the device frame 702, for example via at least one ball bearing;

e) A rotation converter 750, which connects the front rotational axle 710 with the rear rotational axle 730, such that a right or a left rotation of the front rotational axle, is converted to respectively a left or right rotation of the rear rotational axle;

f) A user platform 170, configured as a kneeling platform 670, such that the user platform 670 is connected to the rear rotational axle 730, such that the user platform 670 is configured to be rotatable in a horizontal plane relative to the device frame 702.

Figure 8:
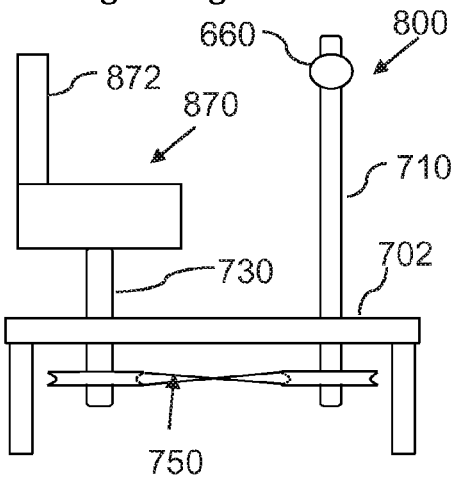
FIG. 8 is a perspective view of an abdominal twist exercise device, configured for use in a sitting position, according to an embodiment of the invention.

In another embodiment, as shown in FIG. 8, an abdominal twist exercise device 800, can be configured for use in a sitting position, such that the user platform 170, is configured as a seat 870, which can include a backrest 872.

Figure 9:
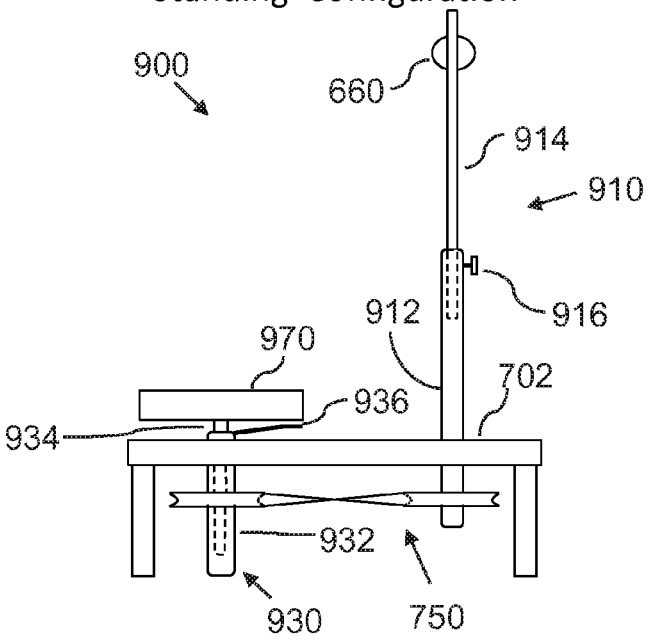
FIG. 9 is a perspective view of an abdominal twist exercise device, configured for use in a standing position, according to an embodiment of the invention.

In yet an embodiment, as shown in FIG. 9, an abdominal twist exercise device 800, can be configured for use in a standing position, such that the user platform 170, is configured as a standing platform 970.

In an embodiment, as shown in FIG. 9, an abdominal twist exercise device 900, can be configured with a height adjustable user platform 970. Such an embodiment can for example use common design methods for pneumatic height adjustable seats for chairs.

In a related embodiment, the rear rotational axle 930 can be telescoping, and can further include a lower rear rotational axle 932 and an upper rear rotational axle 934, such that the upper rear rotational axle 934 slides up and down inside the lower rear rotational axle 932, whereby the user platform 970 is height adjustable.

In a further related embodiment, the rear rotational axle 930 can further include a rear locking lever 936, which can be configured to lock and release the telescoping function of the rear rotating axle 930.

In an embodiment, as shown in FIG. 9, an abdominal twist exercise device 900, can be configured with a height adjustable main handle bar 660.

In a related embodiment, the front rotational axle 910 can be telescoping, and can further include a lower front rotational axle 912 and an upper front rotational axle 914, such that the upper front rotational axle 914 slides up and down inside the lower front rotational axle 912, whereby the main handle bar 660 is height adjustable.

In a further related embodiment, the front rotational axle 910 can further include a front locking lever 916, which can be configured to lock and release the telescoping function of the front rotating axle 910.

Figure 11:
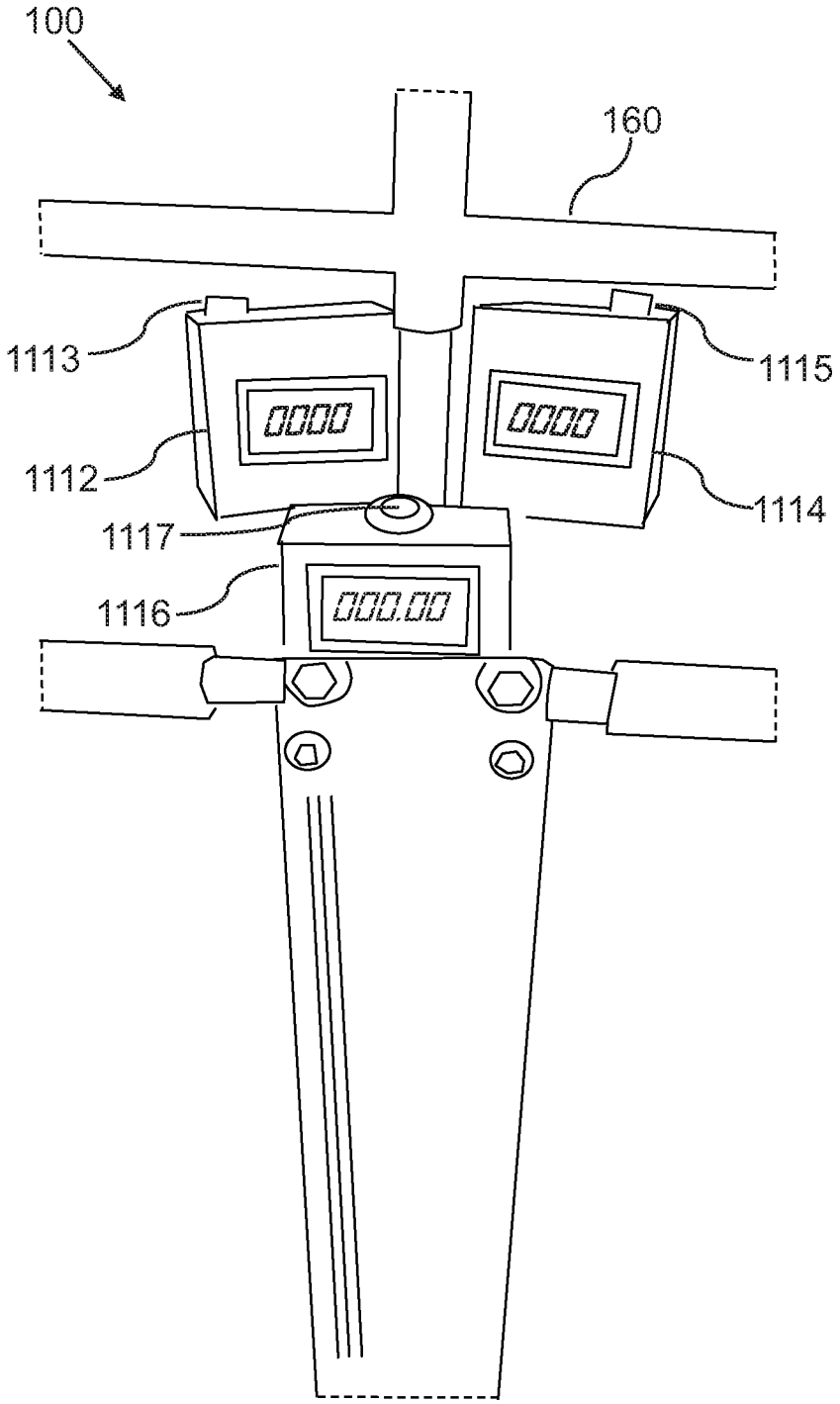
FIG. 11 is a perspective view of a section of an abdominal twist exercise device, configured with counters, according to an embodiment of the invention.

In a related embodiment, as shown in FIG. 11, the abdominal twist exercise device 100 can further include:

a) a front rotation counter 1112, which is connected to the front rotational axle and counts rotation cycles of the front rotational axle, and can further include a front reset button 1113;

b) a rear rotation counter 1114, which is connected to the rear rotational axle and counts rotation cycles of the rear rotational axle, and can further include a rear reset button 1115; and c) a timer 1116, which measures elapsed time of a training session, and can further include a timer reset button 1117.

Here has thus been described a multitude of embodiments of the abdominal twist exercise device, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. An abdominal twist exercise device, comprising:

a) a device frame;

b) a front rotational axle, which is rotationally connected in a lower end to the device frame, such that the front rotational axle extends vertically upwards from the device frame;

c) a main handle bar; which is connected to an upper end of the front rotational axle;

d) a rear rotational axle, which is rotationally connected to the device frame, to a rear of the front rotational axle, such that the rear rotational axle extends vertically upwards from the device frame;

e) a rotation converter, which connects the front rotational axle with the rear rotational axle, such that a right or a left rotation of the front rotational axle is converted to respectively a left or right rotation of the rear rotational axle;

f) a user platform, which is connected to the rear rotational axle, such that the user platform is configured to be horizontally rotatable; and g) a disengaging lever, which is connected to the rotation converter, such that the disengaging lever is configured to be able to disengage the rotation converter;

whereby the abdominal twist exercise device is configured such that when the main handle bar rotates to a left side, the user platform rotates to a right side; and such that when the main handle bar rotates to a right side, the user platform rotates to a left side.

2. The abdominal twist exercise device of claim 1, wherein the front rotational axle is telescoping, such that a height of the main handle bar is adjustable.

3. The abdominal twist exercise device of claim 2, wherein the front rotational axle further includes:

a) a lower front rotational axle; and b) an upper front rotational axle, mounted inside the lower front rotational axle;

such that the upper front rotational axle is configured to slide inside the lower front rotational axle, whereby the main handle bar is height adjustable.

4. The abdominal twist exercise device of claim 3, wherein the front rotational axle further includes a front locking lever, which is configured to lock and release the telescoping function of the front rotating axle.

5. The abdominal twist exercise device of claim 3, wherein the front rotational axle further includes a rear locking lever, which is configured to lock and release the telescoping function of the front rotating axle.

6. The abdominal twist exercise device of claim 1, wherein the rotation converter further comprises:

a) a front chain sprocket, which is perpendicularly connected to the front rotational axle, such that the front chain sprocket is configured to be rotatable in a front horizontal plane;

b) an intermediate rotational axle, which is rotationally connected to the device frame, such that the intermediate rotational axle is parallel to the front rotational axle;

c) an intermediate chain sprocket, which is perpendicularly connected to the intermediate rotational axle, such that the intermediate chain sprocket is configured to be rotatable in the front horizontal plane;

d) a roller chain, which is connected in a front end around the front chain sprocket and in a rear end around the intermediate chain sprocket, such that a right or left rotation of the front rotational axle causes respectively a right or left rotation of the intermediate rotational axle;

e) an intermediate gear which is perpendicularly connected to the intermediate rotational axle such that the intermediate gear is configured to be rotatable in a rear horizontal plane; and f) a rear gear, which is perpendicularly connected to the rear rotational axle, such that the rear gear is configured to be rotatable in the rear horizontal plane;

such that the intermediate gear and the rear gear are meshing and configured as a gear train, which connects the intermediate rotational axle with the rear rotational axle, such that that a right or a left rotation of the intermediate rotational axle causes respectively a left or a right rotation of the rear rotational axle.

7. The abdominal twist exercise device of claim 6, further comprising:

a) a plate, which is connected to the disengaging lever; and b) rails;

such that an end of the intermediate rotational axle is rotationally mounted to the plate, such that the plate is configured to slide in the rails, such that the disengaging lever is configured to disengage the rotation converter, by removing a contact of the rear gear with the front gear.

8. The abdominal twist exercise device of claim 1, further comprising at least one weight, which is attached to the front rotational axle.

9. The abdominal twist exercise device of claim 8, further comprising a weight bar, which is attached to the front rotational axle, such that the weight bar protrudes from the front rotational axle at an upward angle, such that the weight is attached to the weight bar.

10. The abdominal twist exercise device of claim 1, wherein the rear rotational axle is telescoping, such that a height of the user platform is adjustable.

11. The abdominal twist exercise device of claim 10, wherein the rear rotational axle further comprises:

a) a lower rear rotational axle; and b) an upper rear rotational axle, mounted inside the lower rear rotational axle;

such that the upper rear rotational axle is configured to slide inside the lower rear rotational axle.

12. The abdominal twist exercise device of claim 1, wherein the rotation converter further comprises:

a) a front belt sprocket, which is perpendicularly connected to a lower end of the front rotational axle;

b) a rear belt sprocket, which is perpendicularly connected to a lower end of the rear rotational axle; and c) a belt, which is connected in a front end around the front belt sprocket, and in a rear end around the rear belt sprocket, such that the belt is twisted 90 degrees between the front and rear belt sprockets;

such that a right or left rotation of the front rotational axle causes respectively a left or right rotation of the rear rotational axle.

13. The abdominal twist exercise device of claim 1, wherein the rotation converter is configured with a total gearing ratio in a range of 1:3 to 3:1.

14. The abdominal twist exercise device of claim 1, wherein the rotation converter further includes at least one adjustable gear, wherein the front rotational axle further includes:

a) an upper front rotational axle; and b) a lower front rotational axle;

wherein the upper and lower front rotational axles are connected via the adjustable gear.

15. The abdominal twist exercise device of claim 1, wherein the rotation converter further comprises at least one adjustable gear, which is configured to adjust a total gearing ratio of the rotation converter.

16. The abdominal twist exercise device of claim 1, further comprising at least one weight, which is attached to the rear rotational axle.

17. The abdominal twist exercise device of claim 1, further comprising:

a) an elongated support rail, which extends vertically from the device frame; and b) a safety handle bar, which is attached to an upper end of the support rail.

18. The abdominal twist exercise device of claim 1, further comprising legs, which are connected to the device frame and protrude downwards from the device frame, such that the abdominal twist exercise device is configured to be positioned with the legs on a floor surface.

19. The abdominal twist exercise device of claim 1, further comprising:

a) a front rotation counter, which is connected to the front rotational axle and configured to count rotation cycles of the front rotational axle; and b) a rear rotation counter, which is connected to the rear rotational axle and configured to count rotation cycles of the rear rotational axle.

20. An abdominal twist exercise device, comprising:

a) a main handle bar; which is configured to be horizontally rotatable;

b) a user platform, which is configured to be horizontally rotatable; and c) a rotation converter, which connects the main handle bar with the rear user platform, wherein the rotation converter is configured such that a right or a left rotation of the main handle bar is converted to respectively a left or right rotation of the user platform;

d) a disengaging lever, which is connected to the rotation converter, such that the disengaging lever is configured to be able to disengage the rotation converter;

whereby the abdominal twist exercise device is configured such that when the main handle bar rotates to a left side, the user platform rotates to a right side; and such that when the main handle bar rotates to a right side, the user platform rotates to a left side.

21. The abdominal twist exercise device of claim 20, further comprising:

a) a device frame, such that the main handle bar and the user platform are rotationally connected to the device frame; and b) legs, which are connected to the device frame and protrude downwards from the device frame;

such that the abdominal twist exercise device is configured to be positioned with the legs on a floor surface.

22. The abdominal twist exercise device of claim 20, wherein the rotation converter is configured with a total gearing ratio in a range of 1:3 to 3:1.

23. An abdominal twist exercise device, comprising:

a) a device frame;

b) a front rotational axle, which is rotationally connected in a lower end to the device frame, such that the front rotational axle extends vertically upwards from the device frame;

c) a main handle bar; which is connected to an upper end of the front rotational axle;

d) a rear rotational axle, which is rotationally connected to the device frame, to a rear of the front rotational axle, such that the rear rotational axle extends vertically upwards from the device frame;

e) a rotation converter, which connects the front rotational axle with the rear rotational axle, such that a right or a left rotation of the front rotational axle is converted to respectively a left or right rotation of the rear rotational axle, the rotation converter comprising:

a front chain sprocket, which is perpendicularly connected to the front rotational axle, such that the front chain sprocket is configured to be rotatable in a front horizontal plane;

an intermediate rotational axle, which is rotationally connected to the device frame, such that the intermediate rotational axle is parallel to the front rotational axle;

an intermediate chain sprocket, which is perpendicularly connected to the intermediate rotational axle, such that the intermediate chain sprocket is configured to be rotatable in the front horizontal plane;

a roller chain, which is connected in a front end around the front chain sprocket and in a rear end around the intermediate chain sprocket, such that a right or left rotation of the front rotational axle causes respectively a right or left rotation of the intermediate rotational axle;

an intermediate gear which is perpendicularly connected to the intermediate rotational axle such that the intermediate gear is configured to be rotatable in a rear horizontal plane; and a rear gear, which is perpendicularly connected to the rear rotational axle, such that the rear gear is configured to be rotatable in the rear horizontal plane;

such that the intermediate gear and the rear gear are meshing and configured as a gear train, which connects the intermediate rotational axle with the rear rotational axle, such that that a right or a left rotation of the intermediate rotational axle causes respectively a left or a right rotation of the rear rotational axle; and f) a user platform, which is connected to the rear rotational axle, such that the user platform is configured to be horizontally rotatable;

whereby the abdominal twist exercise device is configured such that when the main handle bar rotates to a left side, the user platform rotates to a right side; and such that when the main handle bar rotates to a right side, the user platform rotates to a left side.

24. An abdominal twist exercise device, comprising:

a) a device frame;

b) a front rotational axle, which is rotationally connected in a lower end to the device frame, such that the front rotational axle extends vertically upwards from the device frame;

c) a main handle bar; which is connected to an upper end of the front rotational axle;

d) a rear rotational axle, which is rotationally connected to the device frame, to a rear of the front rotational axle, such that the rear rotational axle extends vertically upwards from the device frame;

e) a rotation converter, which connects the front rotational axle with the rear rotational axle, such that a right or a left rotation of the front rotational axle is converted to respectively a left or right rotation of the rear rotational axle;

f) a user platform, which is connected to the rear rotational axle, such that the user platform is configured to be horizontally rotatable;

g) at least one weight, which is attached to the front rotational axle; and h) a weight bar, which is attached to the front rotational axle, such that the weight bar protrudes from the front rotational axle at an upward angle, such that the weight is attached to the weight bar;

whereby the abdominal twist exercise device is configured such that when the main handle bar rotates to a left side, the user platform rotates to a right side; and such that when the main handle bar rotates to a right side, the user platform rotates to a left side.

25. An abdominal twist exercise device, comprising:

a) a device frame;

b) a front rotational axle, which is rotationally connected in a lower end to the device frame, such that the front rotational axle extends vertically upwards from the device frame;

c) a main handle bar; which is connected to an upper end of the front rotational axle;

d) a rear rotational axle, which is rotationally connected to the device frame, to a rear of the front rotational axle, such that the rear rotational axle extends vertically upwards from the device frame;

e) a rotation converter, which connects the front rotational axle with the rear rotational axle, such that a right or a left rotation of the front rotational axle is converted to respectively a left or right rotation of the rear rotational axle;

f) a user platform, which is connected to the rear rotational axle, such that the user platform is configured to be horizontally rotatable;

g) an elongated support rail, which extends vertically from the device frame; and h) a safety handle bar, which is attached to an upper end of the support rail;

whereby the abdominal twist exercise device is configured such that when the main handle bar rotates to a left side, the user platform rotates to a right side; and such that when the main handle bar rotates to a right side, the user platform rotates to a left side.

* * * * *